US011007533B2

(12) United States Patent
Hoffmann et al.

(10) Patent No.: US 11,007,533 B2
(45) Date of Patent: May 18, 2021

(54) MATERIAL-BED ROLLER MILL

(71) Applicant: Gebr. Pfeiffer SE, Kaiserslautern (DE)

(72) Inventors: Dirk Hoffmann, Trippstadt (DE); Ralf Frankenberger, Kaiserslautern (DE); Karl-Heinz Schütte, Trippstadt (DE); Hardy Lessmeister, Kaiserslautern (DE); Lukas Schmitt, Trippstadt (DE)

(73) Assignee: GEBR. PFEIFFER SE, Kaiserslautern (DE)

( * ) Notice: Subject to any disclaimer, the term of this patent is extended or adjusted under 35 U.S.C. 154(b) by 396 days.

(21) Appl. No.: 15/739,627

(22) PCT Filed: Jun. 15, 2016

(86) PCT No.: PCT/EP2016/063684

§ 371 (c)(1),
(2) Date: Dec. 22, 2017

(87) PCT Pub. No.: WO2016/207039

PCT Pub. Date: Dec. 29, 2016

(65) Prior Publication Data

US 2018/0272355 A1 Sep. 27, 2018

(30) Foreign Application Priority Data

Jun. 23, 2015 (DE) ..... 10 2015 110 033.9

(51) Int. Cl.

| | |
|---|---|
| ***B02C 4/02*** | (2006.01) |
| ***B02C 4/32*** | (2006.01) |
| ***B30B 3/04*** | (2006.01) |

(52) U.S. Cl.

CPC ..... *B02C 4/02* (2013.01); *B02C 4/32* (2013.01); *B30B 3/04* (2013.01); *B02C 2201/02* (2013.01)

(58) Field of Classification Search

CPC .... B02C 4/02; B02C 4/30; B02C 4/32; B02C 4/04; B02C 4/06; B02C 4/08; B02C 4/36; B02C 4/38; B02C 2201/02

See application file for complete search history.

(56) References Cited

U.S. PATENT DOCUMENTS 2,805,028 A * 9/1957 Linden ..... B02C 4/32 241/159
3,099,406 A * 7/1963 Kautz ..... B02C 1/025 241/32

(Continued)

FOREIGN PATENT DOCUMENTS

DE 1 927 164 A1 12/1970
DE 7519443 * 6/1975 ..... B02C 4/28

(Continued)

OTHER PUBLICATIONS

Human Translation of DE 7519443, Translated Oct. 2019, 12 Pages. (Year: 1975).*

(Continued)

*Primary Examiner* — Gregory D Swiatocha
(74) *Attorney, Agent, or Firm* — Ditthavong, Steiner & Mlotkowski

(57) ABSTRACT

A material-bed roller mill including two adjacently arranged rollers which are oriented in an axially parallel manner and which rotate in opposite directions and between which a roller gap is formed, a foundation, two roller mountings, in each of which a roller is rotatably mounted, each roller mounting being secured to the foundation in a pivotal manner; and a clamping device. The clamping device is arranged outside of the roller gap and connects the two roller mountings. Each roller mounting has two rockers which are designed as separate components and each of which is arranged at an end of a roller and can be deflected independently of the other.

12 Claims, 8 Drawing Sheets

(56) References Cited

U.S. PATENT DOCUMENTS

| | | | | |
|---|---|---|---|---|
| 4,154,408 | A | 5/1979 | Boling, Jr. | |
| 5,261,324 | A * | 11/1993 | Jakobs | B30B 3/04 100/158 R |
| 5,765,422 | A * | 6/1998 | Donini | B21B 13/023 72/237 |
| 5,865,112 | A * | 2/1999 | Grabscheid | D21F 3/0218 100/153 |
| 6,171,227 | B1 * | 1/2001 | Spatafora | B21D 13/04 493/403 |
| 7,699,254 | B2 * | 4/2010 | Frangenberg | B02C 4/28 241/231 |
| 8,297,847 | B2 * | 10/2012 | Niklewski | B02C 4/28 384/432 |
| 9,108,377 | B2 * | 8/2015 | Frangenberg | B02C 4/32 |
| 2011/0253825 | A1 * | 10/2011 | Frerich | B02C 4/32 241/231 |

FOREIGN PATENT DOCUMENTS

| | | |
|---|---|---|
| EP | 2 653 227 A1 | 10/2013 |
| EP | 2 653 228 A1 | 10/2013 |

OTHER PUBLICATIONS

"All About Hydraulic Cylinders," Screen Capture of Apr. 26, 2014, slideshare.net/DonaldOutler/all-about-hydraulic-cylinders (Year: 2014).*

International Search Report & Written Opinion issued in PCT/EP2016/063684, dated Sep. 30, 2016.

* cited by examiner

MATERIAL-BED ROLLER MILL

TECHNICAL AREA

The present invention relates to a material-bed roller mill comprising two rollers, which are arranged side by side and in an initial state in axially parallel to one another and which rotate in opposite directions, wherein the rollers form a roller gap between them.

STATE OF THE ART

Such material-bed roller mills, also known as roller presses, are used, for example, in the cement industry, in order to mill cement raw material, cement clinker and granulated slag.

A roller gap or grinding gap is provided between the two grinding rollers of the material-bed roller mill. The material to be crushed is located above the roller gap. The two oppositely driven rollers cause the material to be crushed and pulled through the roller gap, thereby being stressed and thus crushed. The two grinding rollers must be pressed in radial direction with very high forces in the direction of the roller gap, in order to adjust the desired material bed crushing.

Conventionally, in a material-bed roller mill, one roller is designed as a fixed roller and the other one as a loose roller. The pressure necessary for crushing the material to be ground is applied to the loose roller by way of hydraulic cylinders which may be formed in an articulated manner from case to case. A frame is provided for supporting the forces acting on the roller. Since the forces acting on the rollers are large, in particular in the case of very hard mineral materials, the requirements for the stability of the frame are very high. This leads to the fact that material-bed roller mills have a complex frame construction.

The high grinding forces lead to a roller deflection, which inter alia acts on the bearings of the rollers. The requirements for the bearings of the rollers are, therefore, very high in terms of durability and mobility.

In some of the known material-bed roller mills, there is the disadvantage that grinding material, which is significantly larger than the roller gap, expands the roller gap over the entire width. As a result, the grinding quality along the roller gap deteriorates at least temporarily until the oversized or too hard grinding material leaves the roller gap and the desired gap width has been re-adjusted.

Known designs of the material-bed roller mills are often constructed according to the principle of linear guiding. These mills can follow the grinding material movably—also by means of slight inclined positions—and avoid the above-mentioned disadvantage. The orientation of the mill on the bases is complex so as to avoid jamming in the roller guidings.

A further type of embodiment of a material-bed roller mill according to the principle of circular arc guiding, as known, for example, from documents DE 1 927 164 A1 and U.S. Pat. No. 4,154,408 A, has a relatively simple frame construction, but the grinding gap opens in parallel, independently on which position the oversize or too hard grinding material passes through the gap. This results in a worse grinding result.

DESCRIPTION OF THE INVENTION

It is an object of the present invention to provide a material-bed roller mill which is suitable, in particular, to grind very hard material and which has a simple design, in particular a simple frame construction.

Further, it is an object of the present invention to provide a material-bed roller mill, in which the roller deflection does not generate any constraining forces in the roller bearings.

Finally, it is an object of the present invention to improve the grinding quality, in particular to improve the grinding quality of inhomogeneous grinding material with oversized or too hard grinding material.

According to the invention, the object is achieved by means of a material-bed roller mill, comprising two juxtaposed rollers which are arranged in axially parallel to one another in an initial state wherein the rollers are rotating in opposite directions and form between them a roller gap, a base, two roller mountings, in each of which a roller is rotatably mounted, wherein each roller mounting is pivotally attached to the base, and a clamping device acting on the roller gap, which is disposed outside the roller gap and connects both roller mountings to each other, whereby each roller mounting has two rockers, which are formed as separate components, arranged in each case at one end of a roller and are deflectable independently from each other, wherein at least one rocker is able to perform at least two of the following movements: rotary movement about an axis parallel to the roller axis, rotary movement about the longitudinal axis of the rocker, rotary movement about an axis parallel to the longitudinal axis of the rocker, rotary movement about an axis perpendicular to the longitudinal axis of the rocker. The term initial state of the material-bed roller mill is to be understood as the state of the material-bed roller mill, in which there is no ground material in the material-bed roller mill.

The material-bed roller mill according to the invention has a relatively simple and inexpensive construction, since the force-absorbing frame design of known material-bed roller mills is replaced by a roller guide, which is essentially composed of two rocker mounts and two roller mountings.

Additionally, the material-bed roller mill according to the invention is relatively compact, so that the said material-bed roller mill requires a relatively small installation surface. The compact design also reduces the weight and the handling costs of the individual components. The machine's running stability during operation is also increased by the relatively low inertial mass of the components.

Further, according to the invention, the requirements of the material-bed roller mill to the setup tolerance are lower compared to known material-bed roller mills.

The design of the rockers as separate components has the advantage that the rollers, for example for maintenance work on the surface of the roller, are easily accessible from the side facing away from the grinding gap. A time-consuming and costly removal of the rollers is not absolutely necessary.

The separation of the roller mounting into two rockers means a decoupling of the movement of the individual rockers, so that the expansion of the rolling gap during the passage of an oversized or too hard material to be ground can be reduced to a part of the roller width. As a result, the grinding quality is improved over the roller gap width and the energy consumption per milled tonne is reduced.

The fact that at least one rocker is capable of performing at least two different movements, forces arising during grinding because of misalignments of bending rolls are prevented, which leads to a significant relief of the bearings, which are used to support the rollers in the rocker.

Different rotational and pivoting movements can be superimposed in this case, in order to ensure a comparatively high mobility of at least one rocker.

Preferably, at least one rocker of a roller mounting is capable of performing a rotary movement about an axis perpendicular to the longitudinal axis of the rocker and perpendicular to the longitudinal axis of the roller. With this possibility of movement, a relatively high proportion of the forces occurring during the grinding process due to the inclined position of bending rollers can be prevented.

In a preferred embodiment, it is advantageous that at least one rocker is spherically mounted.

It is further preferred that the clamping device comprises two clamping units wherein each unit is connected to two opposing rockers. As a result, a control of the roller gap over the width and thus, a further improvement in grinding quality can be achieved.

Further, it is preferred that the clamping device comprises a clamping cylinder wherein the connecting points of the clamping cylinder are rotatably attached to the rockers. As a result, the clamping cylinders themselves can be designed without complex hinges in the cylinder interior.

It is further advantageous that the clamping device comprises a clamping cylinder wherein at least one end of each clamping cylinder is detachably connected to a rocker. This enables access to the rollers or roller gap for maintenance purposes and in the event of operational malfunctions.

For the purpose of maintenance, it is advantageous that each rocker can be pivoted towards the base from an operating position into a maintenance position. Thus, for example, each rocker can be pivoted, pivoted in the sense of swing out, about at least 15°, preferably up to 90°, towards the base, in order to obtain free access to a roller and, if necessary, in order to be able to exchange the roller.

It is particularly advantageous that a surface or device is provided on each rocker, onto which the rocker can be put down during swinging out. Components, such as, for example, gears, can be stored in the devices during the swing-out operation. The cylinders of the clamping device can be used as auxiliary elements during the swing-out procedure.

Cylindrical roller bearings or slide bearings are preferably used for mounting the rollers since these are comparatively favourable and have a high load-bearing capacity in relation to the structural volume.

It was found that the grinding surfaces of loose rollers wear out more quickly than those of the fixed rollers. It is preferred that each roller mounting has at least one receptacle for locking bolts so that each roller can be used as a loose roller and a fixed roller, in order to obtain the most uniform wearing of the rollers.

BRIEF DESCRIPTION OF THE DRAWINGS

Preferred embodiments are explained in more detail with reference to the accompanying drawings, in which.

WAYS OF PERFORMING THE INVENTION AND COMMERCIAL USABILITY

Figure 1:
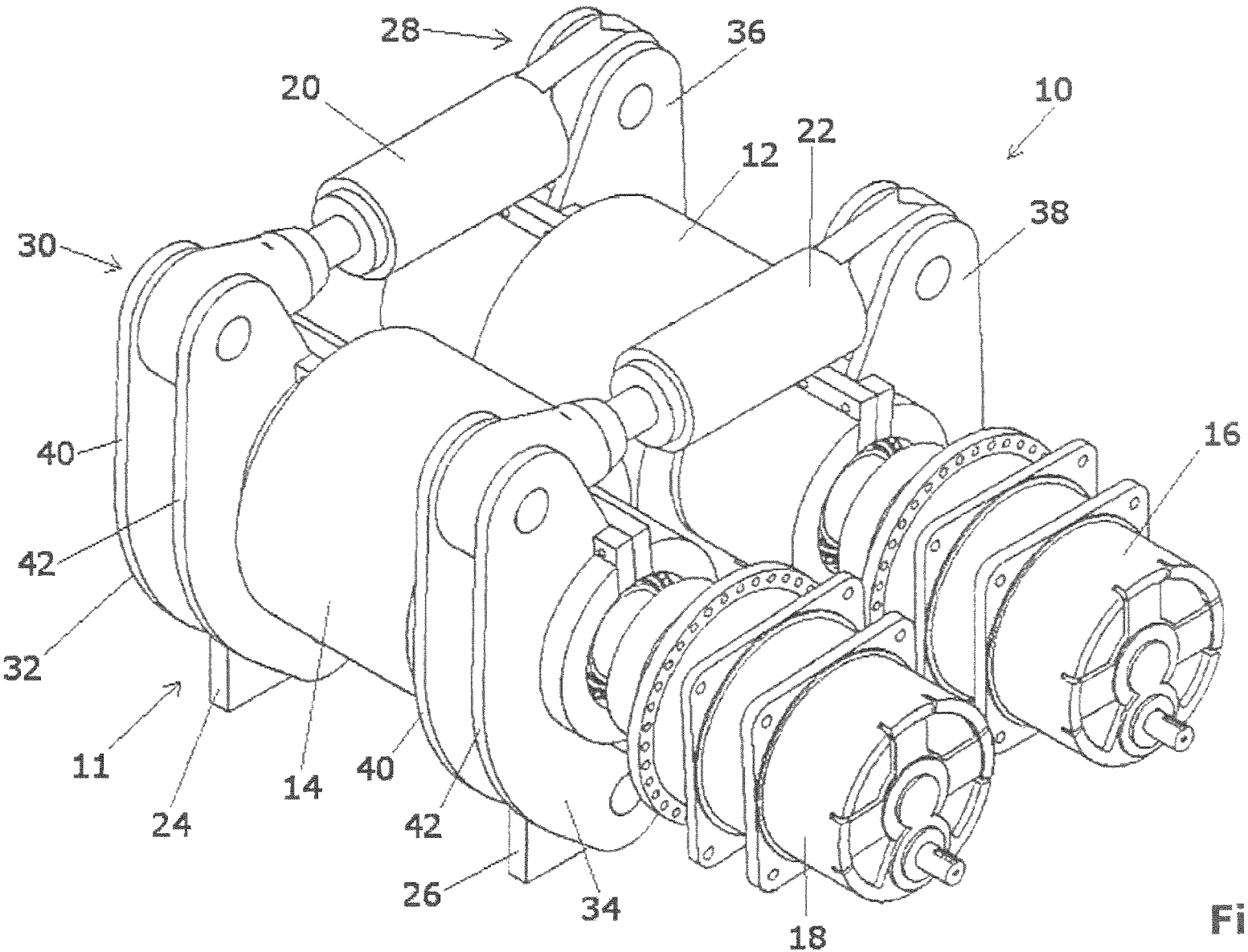
FIG. 1 is a perspective view of a material-bed roller mill according to a first embodiment.

FIG. 1 shows a material-bed roller mill 10 in a perspective and oblique top view. The material-bed roller mill 10 comprises two axially parallel rollers 12, 14 arranged side by side, which are mounted rotatably. The rollers 12, 14 can be individually driven by means of drive units 16, 18 and counter-rotate in a known manner. Further, a clamping device with clamping cylinders 20, 22 such as hydraulic cylinders, is provided. The clamping device is arranged outside, in particular above the roller gap formed by the rollers 12, 14.

A base 11 comprises two parallel and spaced-apart, strip-shaped rocker mounts 24, 26, which are aligned essentially perpendicular to the axis of the rollers 12, 14. Two roller mountings 28, 30 are arranged on the base 11, in each of which a roller 12, 14 is rotatably mounted. Each roller mounting 28, 30 has two rockers 32, 34 or 36, 38, respectively, which are designed as separate components and which are each rotatably and pivotably attached to the rocker mounts 24.

The rockers 32, 34 or 36, 38 can be deflected independently of one another.

Each rocker 32, 34, 36, 38 comprises two substantially C-shaped plate elements 40, 42, which are arranged in parallel and at a distance from each other. In each case the upper and lower sections of the two C-shaped plate elements 40, 42 are connected to each other by means of an upper rocker axis 44 and a lower rocker axis 46 (see FIG. 3).

In the rocker mounts 24, 26, bores are provided, through which the lower rocker axis 46 reaches. In this way, a hinge joint is formed between the base, in particular between the rocker mount 24, 26 and the corresponding rockers 32, 34, 36, 38. In order to achieve a low-friction pivoting of the rockers 32, 34, 36, 38 with respect to the rocker mount 24, 26, maintenance-free joint bearings (not shown) are provided.

Each clamping cylinder 20, 22 has a bore at its two end sections, through which the upper rocker axis 44 reaches. This results in a hinge joint between a rocker 32, 34, 36, 38 and an end section of the clamping cylinder 20, 22. Although not shown, joint bearings are provided, in order to achieve a low-friction pivoting movement between clamping cylinders 20, 22 and rockers 32, 34, 36, 38.

The two clamping cylinders 20, 22 are detachably connected to the rockers 32, 34, 36, 38.

Figure 2:
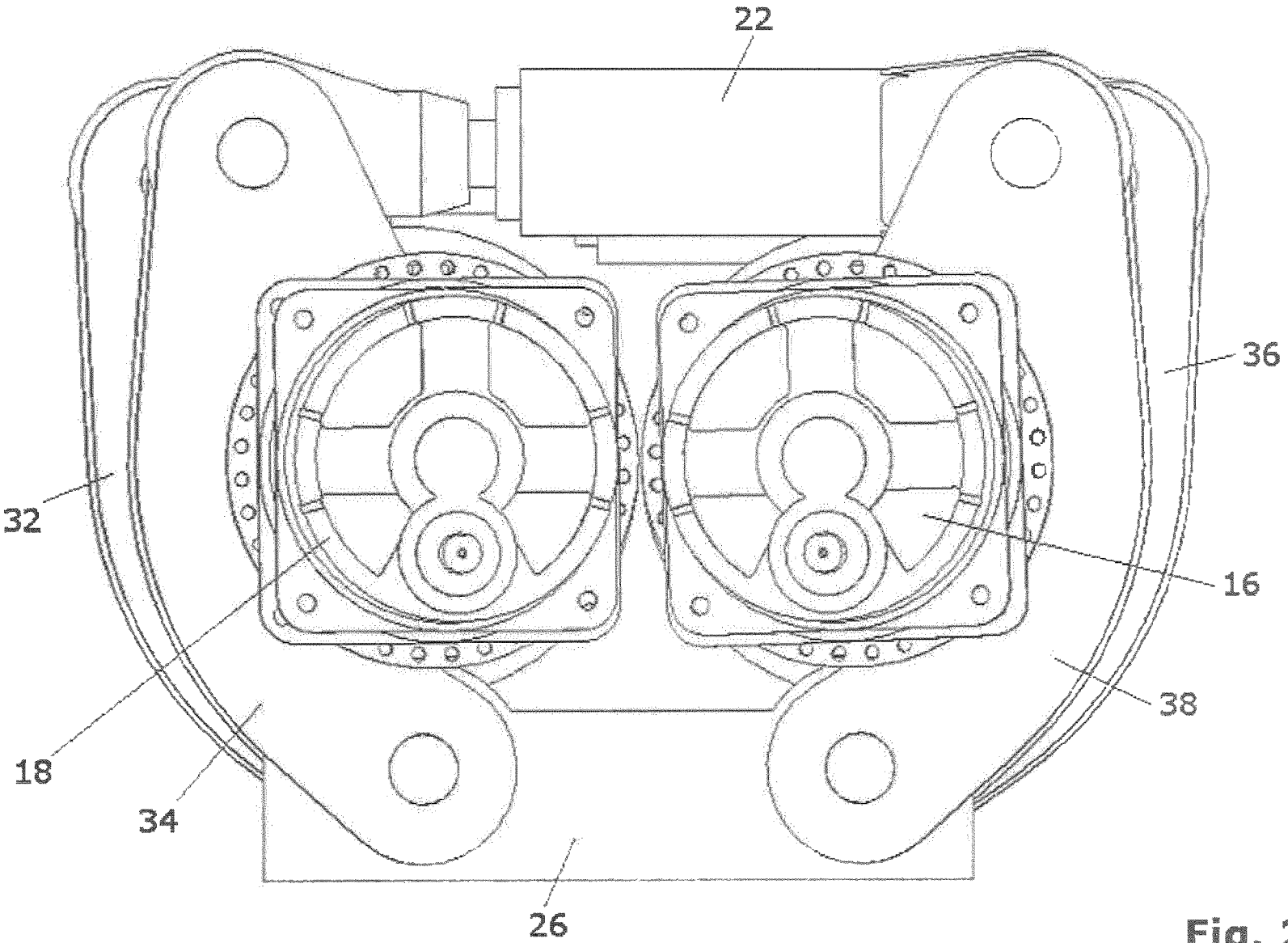
FIG. 2 shows the material-bed roller mill according to the first embodiment from the front.

As can be seen, in particular in FIG. 2, a respective rocker mount 24, 26, the two rockers 32, 36 or 34, 38 attached to the rocker mount 24 or 26, and the associated clamping cylinder 20 or 22 form two frames arranged in succession, in which the two rollers 12, 14 are arranged.

Figure 3:
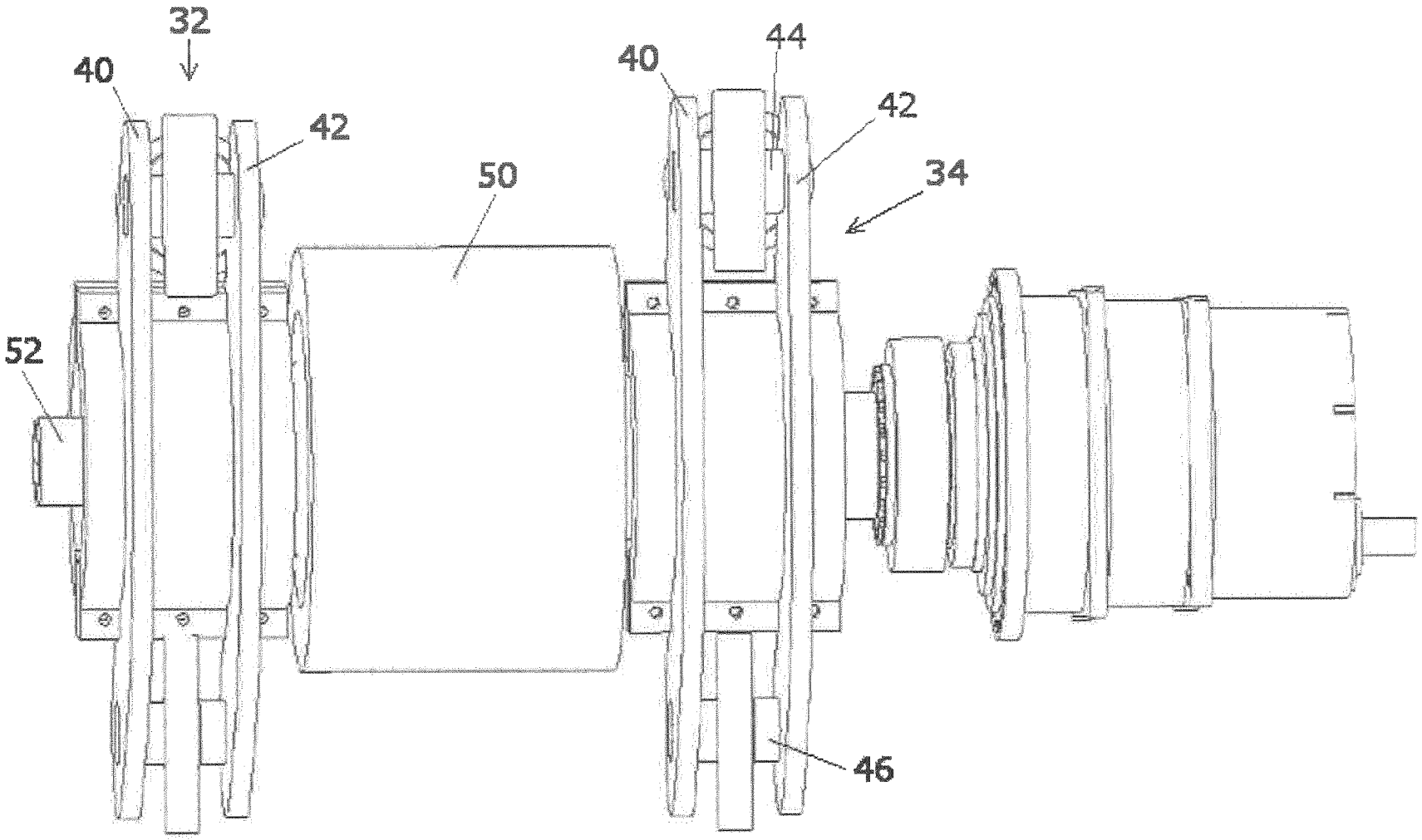
FIG. 3 shows a side view of the material-bed roller mill according to the first embodiment.

The rollers 12, 14 each have a roller body 50 and a shaft 52 (see FIG. 3). At both rollers 12, 14 the rockers 32, 34, 36, 38 are arranged on the shaft 52 on both sides of the roller body 50, whereby the rollers 12, 14 are each rotatably mounted in the concave portion of each rockers 32, 34, 36. The rollers 12, 14 are supported by means of suitable bearings, such as roller bearings and/or slide bearings. In particular, multi-row cylindrical roller bearings, multi-row tapered roller bearings or radial slide bearings are suitable.

Figure 4:
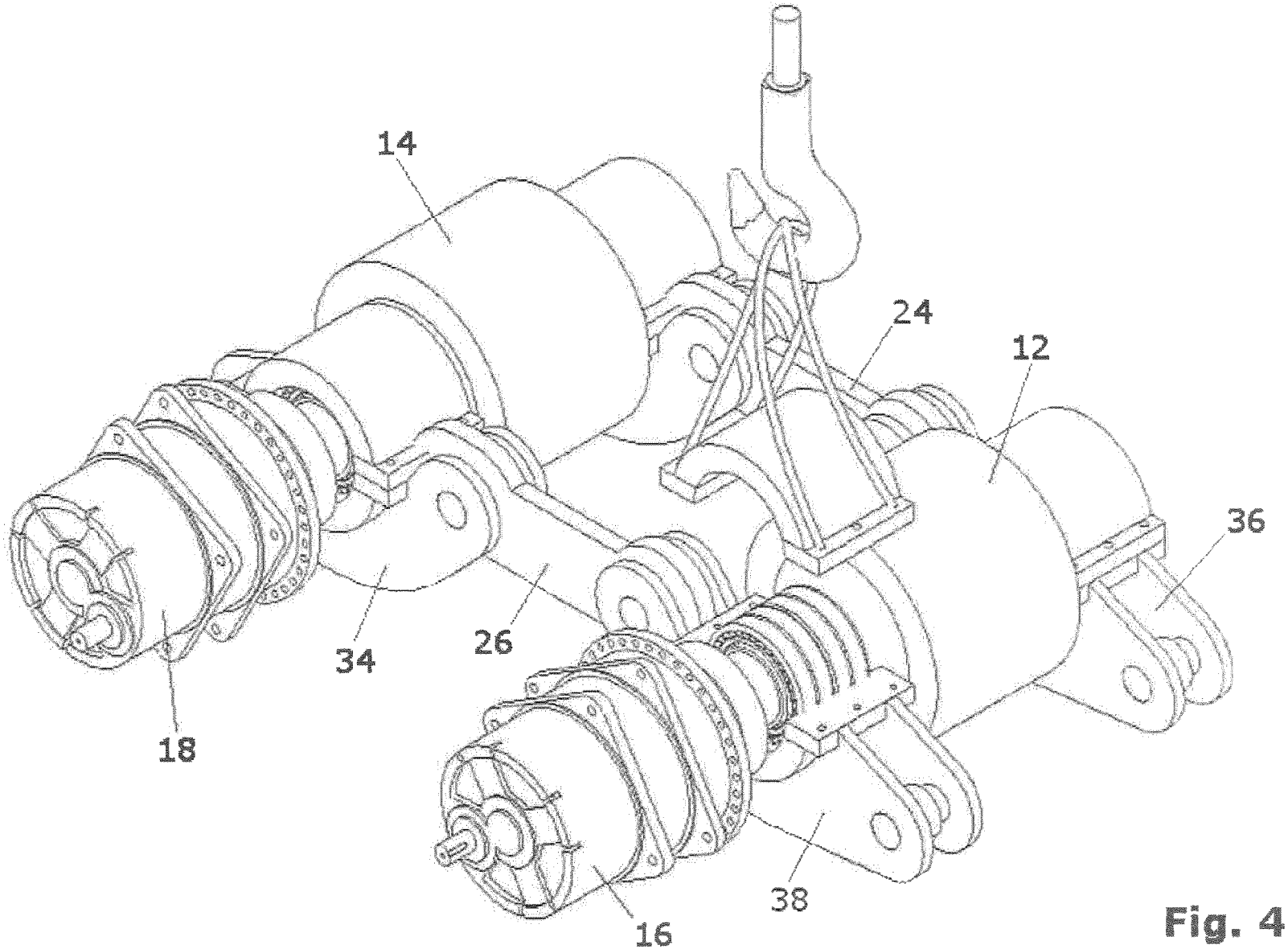
FIG. 4 shows the material-bed roller mill according to the first embodiment in a maintenance position.

FIG. 4 shows the material-bed roller mill 10 in a maintenance position. In this case, the clamping cylinders 20, 22 are removed from the rockers 32, 34, 36, 38. The rockers 32, 34, 36, 38 are pivoted or swung out outwardly so that the rollers 12, 14 are freely accessible to perform maintenance work on the rollers or to exchange them. Alternatively, the clamping cylinders 20, 22 can be uncoupled on one side.

As can be seen in FIG. 4, the rockers 32, 34, 36, 38 can be pivoted around a large angle with respect to the rocker mount 24, 26, in particular around an angle >15°, preferably up to an angle of 90°.

Figure 5:
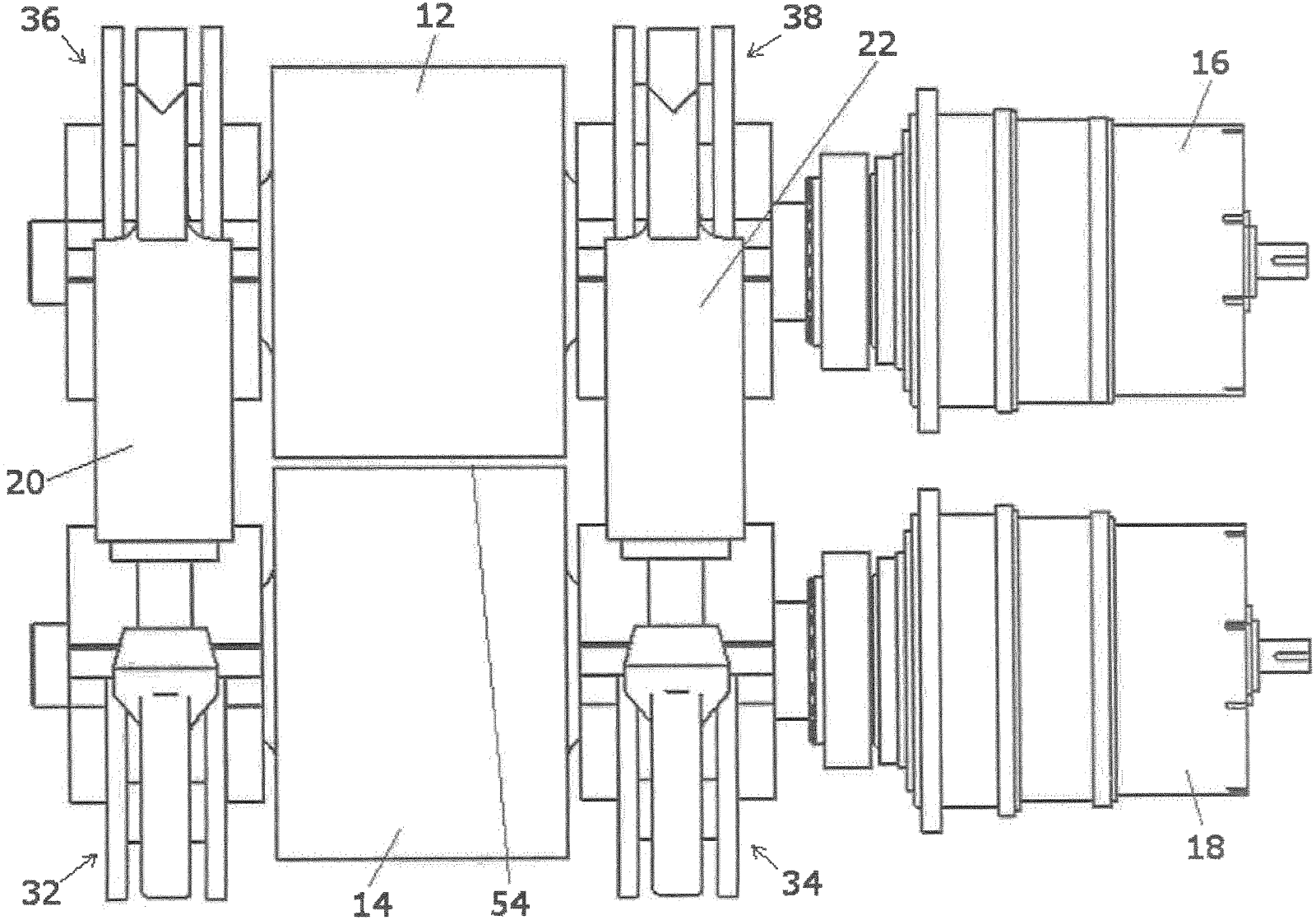
FIG. 5 shows the material-bed roller mill according to the first embodiment in the initial position.

FIG. 5 shows the material-bed roller mill 10 in an initial state. The two rollers 12, 14 have a uniform roller gap 54 across the width of the roller 12, 14. The two clamping cylinders 20, 22 are located in their initial position.

For the grinding process, the ground material is placed above the roller gap 54 on the two rollers 12, 14. Due to the friction on the roller surface, the material to be ground is drawn into the roller gap 54 and crushed in the roller gap 54. The rockers 32, 36 or 34, 38, the clamping cylinders 20, 22 and the rocker mounts 24, 26 absorb the force, which the grinding material exerts on the rollers 12, 14 in the roller gap 54 and ensure that the roller gap 54 does not essentially change during the grinding process.

Figure 6:
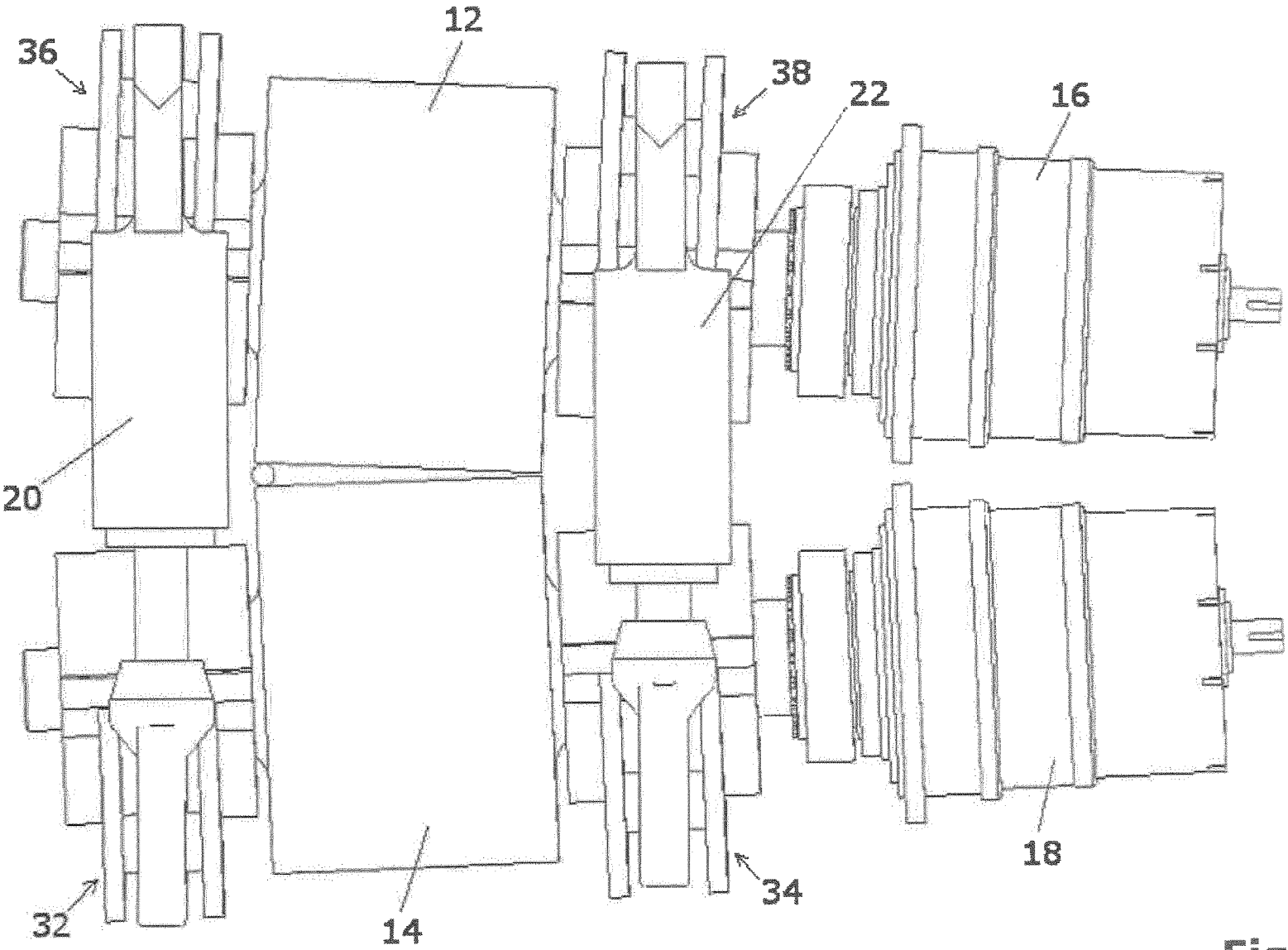
FIG. 6 shows the material-bed roller mill from above with a foreign body passage.

FIG. 6 shows an operating state, in which material to be ground passes into the roller gap 54, which is larger than the roller gap and should be crushed according to the intended use. If a large grain or foreign body is very hard and cannot be crushed by the rollers 12, 14, then the distance between the rollers 12, 14 must be increased, for example in order to avoid damage to the rollers 12, 14. For this purpose, the clamping cylinders 20, 22 are deflected, i.e., extended, so as to allow too large or too hard the material to pass through. The rockers 32, 36 or 34, 38, respectively, are deflected.

Each of the rockers 32, 34 or 36, 38 respectively is capable of performing a pivotal movement about an axis parallel to the roller axis. The pivoting movement about the axis parallel to the roller axis ensures that the distance between the rollers 12, 14 can be increased or decreased. While the material to be ground presses the rollers 12, 14 outwards from the grinding gap, the clamping cylinders 20, 22 provide a counterforce, so that the distance between the rollers 12, 14 remains nearly the same.

Further, each rocker 32, 34 or 36, 38 is able to rotate about its longitudinal axis or an axis parallel to its longitudinal axis. In this case, the entire rocker 32, 34 or 36, 38 can be rotated as a rigid body about a rotational axis.

Finally, the rockers 32, 34 or 36, 38 can swerve sidewise elastically or pivot about an axis perpendicular to the roller axis and its longitudinal axis.

The pivoting and rotation movements can occur superimposed.

Since the rockers 32, 34 and/or 36, 38, respectively, are not rigid, but are connected by means of a hinge joint to the base, in particular to the rocker mounts 24, 26 and can be further pivoted, possibly twisted in themselves, the rockers 32, 34 and/or 36, 38 at least partially follow the deflection of the roller axis due to a large grain or foreign body and thus absorb a part of the forces that occur during the deflection of the rollers 12, 14. The force that occurs on the roller bearing between roller 12, 14 and rockers 32, 34 and/or 36, 38 respectively, due to a roller deflection, is significantly reduced as compared to a rigid connection between rocker and base, in which the entire force, which occurs due to a roller deflection is transmitted to the bearing between the rocker and roller.

Because of the fact that the rockers can rotate in themselves, the load on the corresponding bearings on the rollers or clamping cylinders is significantly reduced as compared to conventional material-bed roller mills. An angular mobility of the roller bearings is thus not necessary. This makes it possible to use cost-effective cylindrical roller bearings. Expensive spherical roller bearings can be dispensed with.

Figure 7:
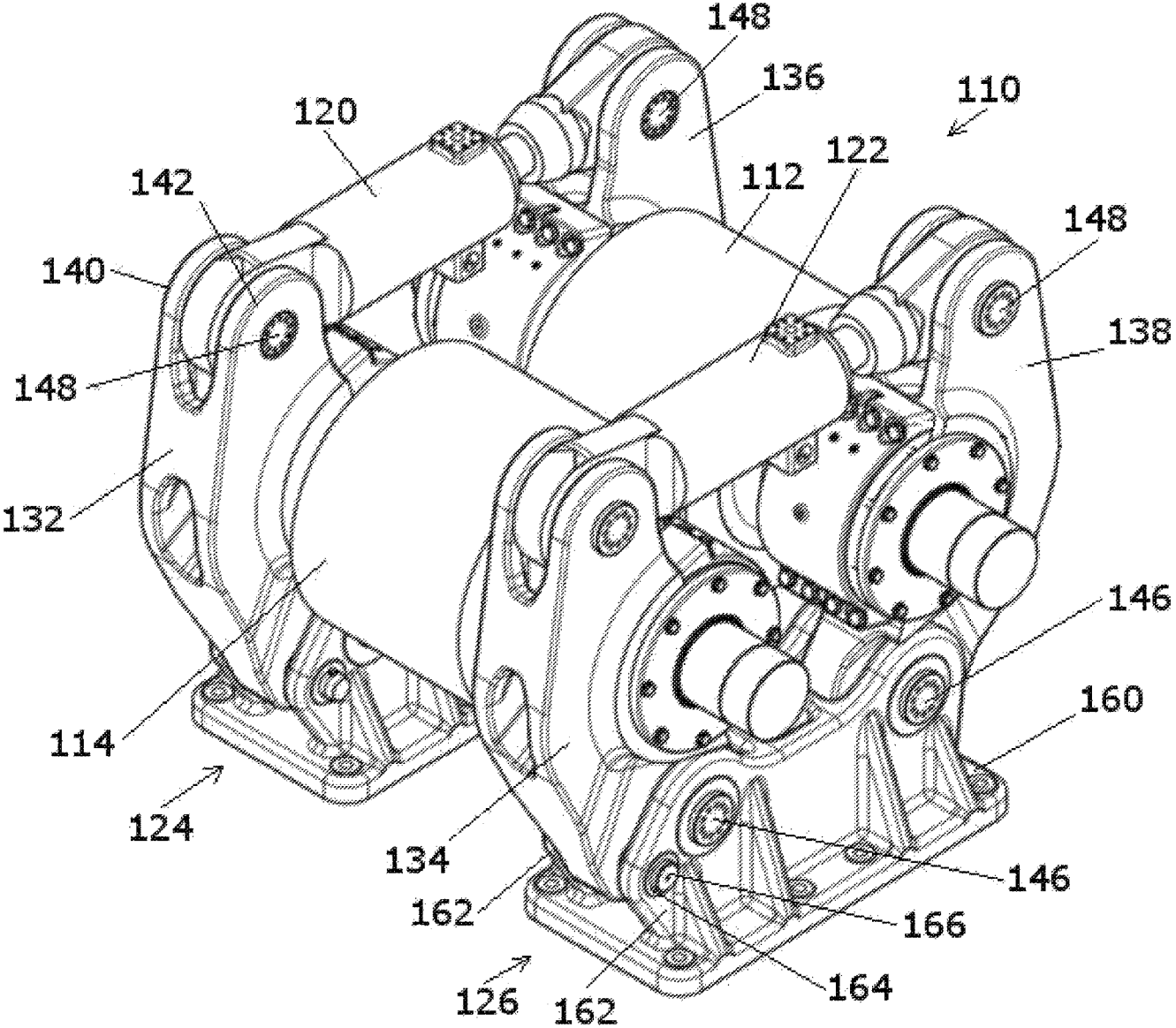
FIG. 7 shows a perspective view of a material-bed roller mill according to a second embodiment.

FIG. 7 shows a second embodiment of a material-bed roller mill 110 in a perspective view from an inclined position upwards. The embodiment of a material-bed roller mill 110, as shown in FIG. 7, differs from the embodiments of a material-bed roller mill 10, illustrated in FIGS. 1 to 6, in that the rockers and the base are designed differently.

The rockers 132, 134 or 136, 138 of the roller press 110 have two essentially C-shaped plate elements 140, 142 which are connected to each other at least in sections on their rear side.

At the upper section of the rocker an upper rocker axis 148 is provided, on which the respective clamping cylinders 120, 122 are arranged in an articulated manner.

The rocker mounts 124, 126 each comprise a bottom plate 160 and two side walls 162, arranged perpendicular to the base plate at a distance from one another, wherein opposing rockers 132, 136 and/or 134, 138, respectively, are mounted between the two side walls 162 in the rocker mount 124, 126 and are rotatable about a lower rocker axis 146.

Further, a bore 164 is provided in the rockers 132 and 134 as well as in the rocker mounts 124 and 126, through which a locking bolt 166 can be passed, so that, in the embodiment shown in FIG. 7, the left roller 114 acts as a fixed roller and the right roller 112 is formed as a loose roller.

Operating experience with material-bed roller mills has often shown that the grinding surfaces of loose rollers wear out more quickly than those of the fixed rollers.

Figure 8:
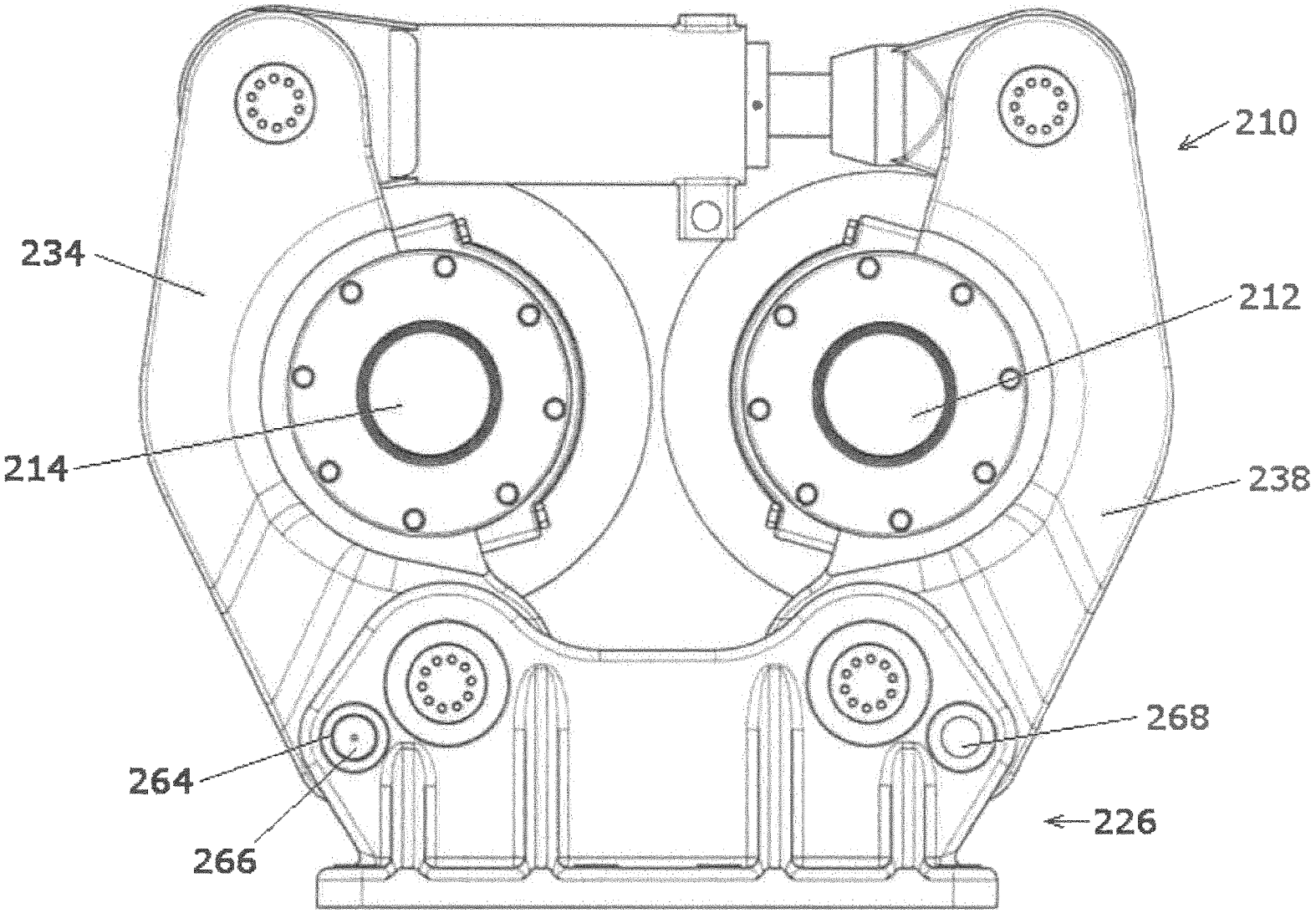
FIG. 8 shows a front view of a material-bed roller mill.

FIG. 8 shows a third embodiment of a material-bed roller mill 210, which differs from the previously described material-bed roller mills, in that both rollers 212, 214 can be used either as a loose roller or as a fixed roller. For this purpose, in addition to the bore 264 in the rocker mount 226 and in the rocker 234 for accommodating a locking bolt 264, a further bore 268 is provided for accommodating a locking bolt in the rocker mount 226 and in the rocker 238.

In the embodiments shown, the two counter-rotating rollers are operated in a fixed-roller/loose-roller pairing. Alternatively, the material-bed roller mill can be operated with the aid of additional elements with two loose rollers.

It is common to all embodiments that due to the present lever ratios of the illustrated material-bed roller mills 10; 110, 210, the force of the clamping cylinders is increased by a ratio of 2:1.

The invention claimed is:

1. A material-bed roller mill comprising:

two juxtaposed rollers arranged in an initial state axially parallel to each other and rotatable in opposite directions and forming a roller gap between them, each roller having a longitudinal axis, a base, two roller mountings, in each of which one of the two rollers is rotatably mounted, wherein each roller mounting is pivotally attached to the base, and a clamping device which is arranged outside the roller gap and interconnects the roller mountings, wherein each roller mounting has two rockers, formed as separate components, respectively arranged at ends of each of the rollers and being deflectable independently of each other, wherein each rocker has a longitudinal axis, wherein at least one of the rockers of a respective one of the roller mountings is capable of performing at least two of the following movements:

pivoting movement about an axis parallel to the longitudinal axis of the roller of the respective one of the roller mountings, rotary movement about the longitudinal axis of the at least one rocker, rotary movement about an axis parallel to the longitudinal axis of the at least one rocker, rotary movement about an axis being perpendicular to the longitudinal axis of the at least one rocker and being different from an axis parallel to the longitudinal axis of the roller of a respective one of the roller mountings.

2. The material-bed roller mill according to claim 1, wherein the at least one rocker is capable of performing a rotary movement about the axis perpendicular to the longitudinal axis of the at least one rocker and an axis perpendicular to the longitudinal axis of the roller of the respective one of the roller mountings.

3. The material-bed roller mill according to claim 1, wherein the at least one rocker is spherically mounted.

4. The material-bed roller mill according to claim 1, wherein the clamping device comprises two clamping units, wherein each clamping unit is connected to at least one of the rockers of each of the respective roller mountings.

5. The material-bed roller mill according to claim 1, wherein the at least one rocker is connected to the base and/or the clamping device by a hinge joint.

6. The material-bed roller mill according to claim 1, wherein the clamping device comprises a clamping cylinder rotatably attached to a mutually opposing pair of the rockers.

7. The material-bed roller mill according to claim 1, wherein the clamping device comprises a clamping cylinder, wherein at least one end of the clamping cylinder is detachably connected to one of the rockers.

8. The material-bed roller mill according to claim 7, further comprising a support for the clamping cylinder comprising cylindrical roller bearings or slide bearings.

9. The material-bed roller mill according to claim 1, wherein each rocker is pivotable towards the base from an operating position into a maintenance position.

10. The material-bed roller mill according to claim 9, wherein each rocker is pivotable towards the base by an angle in a range of at least 15° to 90°.

11. The material-bed roller mill according to claim 1, further comprising a support for the rollers comprising cylindrical roller bearings or slide bearings.

12. The material-bed roller mill according to claim 1, wherein each roller mounting has at least one mount for locking bolts.

* * * * *